US006041930A

United States Patent [19]

Cockburn

[11] Patent Number: 6,041,930

[45] Date of Patent: Mar. 28, 2000

[54] BREAKABLE SACHET

[75] Inventor: Harry George Cockburn, Christchurch, New Zealand

[73] Assignee: Thornton Trustee Company Ltd., New Zealand

[21] Appl. No.: 09/011,314

[22] PCT Filed: Jul. 26, 1996

[86] PCT No.: PCT/NZ96/00078

§ 371 Date: Apr. 7, 1998

§ 102(e) Date: Apr. 7, 1998

[87] PCT Pub. No.: WO97/06073

PCT Pub. Date: Feb. 20, 1997

[30] Foreign Application Priority Data

Aug. 4, 1995 [NZ] New Zealand ..... 272718

[51] Int. Cl.[7] ..... B65D 73/00

[52] U.S. Cl. ..... 206/484; 206/469; 53/451

[58] Field of Search ..... 206/469, 484, 206/531, 532, 524.1; 53/450–454; 383/200, 201, 207

[56] References Cited

U.S. PATENT DOCUMENTS 3,924,747 12/1975 Gerner ..... 206/484
3,948,394 4/1976 Hellstrom ..... 206/531
3,986,640 10/1976 Redmond ..... 206/469
4,011,949 3/1977 Braber et al. ..... 206/532
4,125,190 11/1978 Davie, Jr. et al. ..... 206/469
4,158,411 6/1979 Hall et al. ..... 206/531
4,371,080 2/1983 Hainess et al. ..... 206/531
5,613,609 3/1997 Hamilton et al. ..... 206/531

*Primary Examiner*—Jim Foster
*Attorney, Agent, or Firm*—Fitzpatrick Cella, Harper & Scinto

[57] ABSTRACT

A breakable sachet and method of manufacturing same is described. The sachet is formed from layers (11, 12, 13) of plastics film sealed so as to form a reservoir (19). The sachet further incorporates a semi-rigid layer (11) which is scored or weakened (15) so that when the semi-rigid layer is bent, it fractures along the score (15) and the contents of the reservoir can be expelled via a hole (16), formed proximate the fracture point, in controlled manner. A method of manufacturing the sachets includes forming a vertical reservoir which includes a semi-rigid layer (33), the reservoir is partitioned by means of a hot roller (34, 35) and the webs (31, 32, 33) forming the reservoir and sealed to the semi-rigid layer (33) include a hole (16) formed therein. The semi-rigid layer (33) includes a score or weak point (15).

8 Claims, 3 Drawing Sheets

BREAKABLE SACHET

TECHNICAL FIELD

The present invention relates to sachets. More particularly, although not exclusively, the present invention relates a sachet for storing and dispensing quantities of liquid, paste, powder or similar substances in discrete predetermined quantities. The present invention further relates to an apparatus and method for producing said sachets.

The general area of application of the present invention is in the production and distribution of food condiments. However, other applications such as dispensing medicines, glues, cosmetics and the like are envisaged.

BACKGROUND OF THE INVENTION

Sachets known in the art include flexible sachets wherein the contents are expelled by, for example, tearing off a corner or end of the sachet and exerting pressure on the exterior of the sachet.

Other prior art devices include rigid moulded "tray" or "blister" type sachets wherein the condiment or similar substance is sealed in by means of an aluminium foil or plastic lid. The lid is heat-sealed or otherwise secured to the upper edges of the tray. In this case the contents are extracted by peeling back the foil lid and either exerting pressure on the lid and the plastic tray or by using an implement such as a knife or spoon to extract the contents.

These constructions suffer disadvantages in that they can be expensive to manufacture, messy to use and, when extracting the contents of the sachet, behave unpredictably in terms of the flow of the substance through, for example, the aperture formed by tearing off the corner of the sachet. In the case of the tear-back foil lid the mobility and ease of extraction of the contents may vary depending on the viscosity of the contents.

There have been attempts to overcome these disadvantages in the prior art, however they have met with mixed success. One solution includes dividing the rigid tray into two sections and providing a perforated "beak" in a more substantial plastic or foil lid. The beak is located between the two tray sections wherein the tray sections in the beak are arranged so that when the ends of the condiment tray are bent towards each other in such a manner as to crush one section against another, the beak cracks along the aforesaid perforation and the contents may be expelled through the cracked beak by squeezing. This construction suffers from disadvantages in that the perforations sometimes crack in transit, and the contents of the tray sections can spoil or be otherwise contaminated. They are also more complicated structurally and therefore more expensive to manufacture.

It is an object of the present invention to provide a sachet and a means and method for producing the same, which overcomes or at least mitigates the above mentioned disadvantages, or at least provides the public with a useful choice.

DISCLOSURE OF THE INVENTION

According to one aspect of the invention there is provided a sachet formed from a plurality of plastics layers sandwiched together to form a reservoir wherein at least one of said layers is a semi-rigid plastics layer adapted so that upon bending said semi-rigid plastics layer will fracture, said semi-rigid plastics layer is located so as to form an outside layer of said plastics layers.

The sachet can be formed from two plastics layers and one semi-rigid layer wherein the plastics layer adjacent the semi-rigid layer incorporates an aperture located proximate said fracture.

Alternatively, the sachet can be formed from one plastics layer and one semi-rigid layer wherein the reservoir is formed therebetween.

The sachet can be elongate, oval or similar suitable shape.

The semi-rigid plastics layer can incorporate a scored line or a region of weakness to effect the fracture.

The reservoir can contain a liquid, paste, powder or similar substance.

The reservoir can, with suitable adaptation contain a powder, granules or similar dry substance.

In an alternative embodiment, the semi-rigid plastics layer may be smaller than the reservoir formed from the first and second flexible plastics layers, the geometry of the plastics layers being adapted so that the reservoir forms a flexible bag and the semi-rigid layer forms an opening means.

In use, the sachet is adapted so that when it is bent the semi-rigid layer fractures and upon further bending and subsequent compression of the reservoir contents, the liquid, paste or similar substance is forced through the aperture and out of the sachet.

According to another aspect of the invention there is provided a sachet formed from a plurality of layers sandwiched together to form a reservoir wherein a centre layer is semipermeable so that removal of a sealing layer allows a fluid in the reservoir to permeate to atmosphere.

The layers can be two plastics layers and the sealing layer sandwiched together with the reservoir formed between the plastics layers, the centre layer being semipermeable.

The sealing layer can be formed from a plastic or other material which is removable.

The liquid in the reservoir can be scented, an air freshener or slow release insect repellent or killer.

In a further aspect the present invention provides for a method of manufacturing sachets comprising continuously sandwiching together a plurality of plastics layers so that a continuous reservoir is formed therebetween; said continuous reservoir is filled with a liquid, paste or similar substance to be contained therein; and the continuous reservoir is subdivided into the discrete segments wherein each segment corresponds to a sachet reservoir.

In a preferred embodiment the method comprises: sandwiching two plastics layers and one semi-rigid layer together in such a way as to form a continuous elongate reservoir wherein the plastics layer adjacent the semi-rigid layer has an aperture formed therein prior to forming said continuous reservoir; the reservoir is filled with a liquid, paste or similar substance and the reservoir is fed continuously through a hot roller, the hot roller being adapted to seal the continuous reservoir substantially perpendicular to the elongate direction of said continuous reservoir and in such a manner as to form discrete reservoirs corresponding to each sachet reservoir.

Preferably a dumb-bell shaped hot roller is used to form the continuous elongate reservoir.

Preferably the hot roller which seals the reservoir into discrete reservoirs is cog shaped in cross-section, the cog teeth forming the sealing surface.

Preferably, the sealing step can be repeated.

Preferably the semi-rigid layer and the adjacent layer are pre-laminated prior to the addition of any further layers.

A fracture line or score can be formed in the semi-rigid layer during manufacture or be preformed in the semi-rigid layer.

Preferably, the fracture line or score has dimensions such that the semi-rigid layer fractures in a region proximate the hole in the plastics layer.

Preferably the continuous reservoir is oriented substantially vertically and filled using delivery means having an outlet located in the continuous reservoir formed between the two plastics layers.

The plurality of plastics layers can be sealed by heat, heat activated glue or similar means.

Further objects and advantages will become apparent in the following description which will be by way of example only and with reference to the accompanying drawings.

In the example shown in FIGS. 1 to 4 the sachet is made up of three plastics layers 11, 12 and 13. Layer 11 corresponds to the semi-rigid plastics layer and layers 12 and 13 correspond to the flexible plastics layers which between them form the reservoir which contains the liquid, paste, or similar substance indicated in outline by 19.

For clarity, the thickness of the layers have been exaggerated in FIGS. 1 to 4. In practice the layers 12 and 13 will be plastics films and the semi-rigid layer 11 will be approximately 0.5 mm thick.

It is to be understood that variations in these thicknesses are within the scope of one skilled in the art and the present example is not to be construed restrictively.

Figure 1:
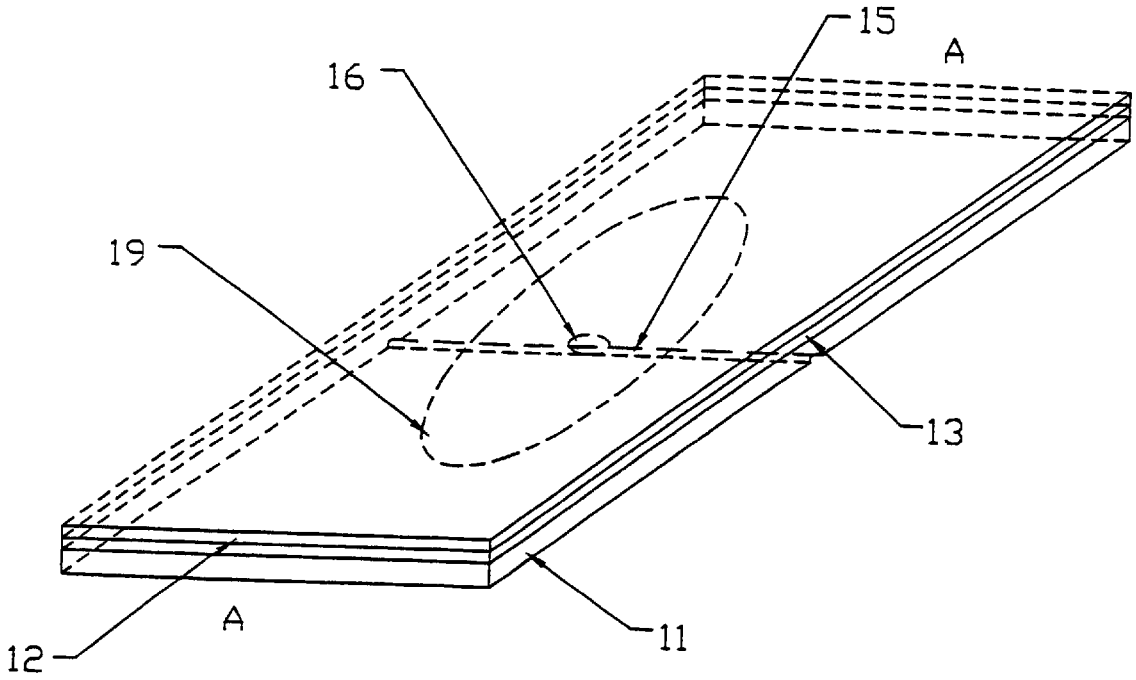
FIG. 1 illustrates a perspective view of a sachet.
Figure 2:
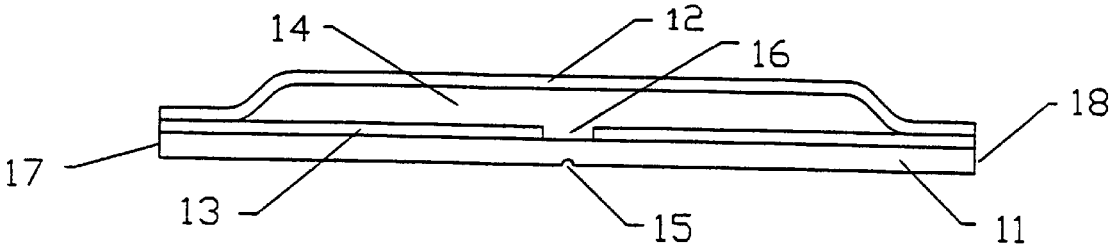
FIG. 2 shows a section through the sachet along line A—A.
Figure 3:
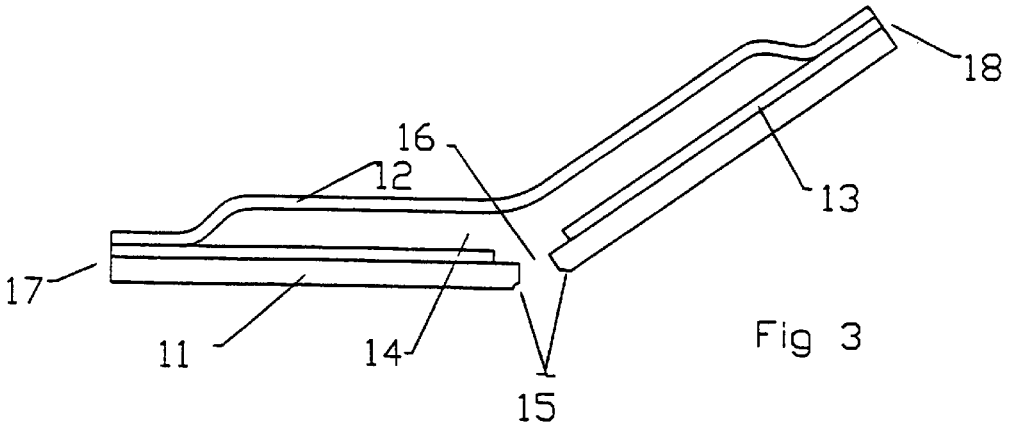
FIG. 3 illustrates the sachet through the section A—A when the contents are being extracted.
Figure 4:
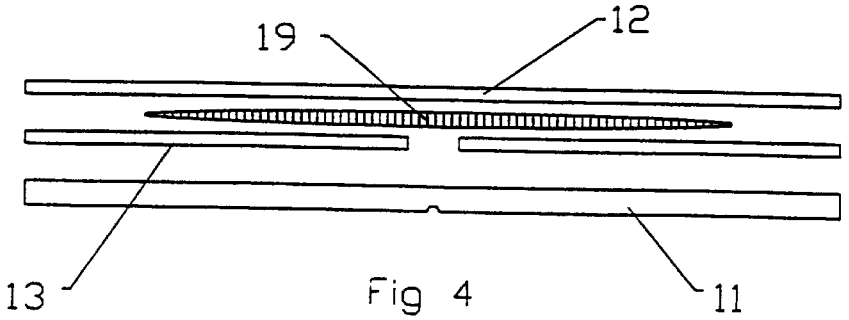
FIG. 4 illustrates an exploded view of section A—A.

Referring to FIG. 2, the semi-rigid plastics layer 11 incorporates a transverse "score" 15. This is to provide a predictable fracture line so that when the ends 17 and 18 of the sachet are drawn together the reservoir 14 may be compressed between the two halves. The transverse score 15 acts as a weak point and the semi-rigid plastic layer 11 will fracture cleanly along that line, thereby providing a fracture region. The orientation of the fracture line is not restricted to transverse and other configurations are envisaged such as diagonal or offset from the centre. The fracture need not form a straight edge. Depending on the particular application, a curved, diagonal or serrated edge may be suitable. Also, while the transverse score is shown extending completely across the sachet, it may stop short of the edges and therefore provide a weak point primarily in the region near the hole. This avoids the possibility of sharp edge being produced at the edge of the broken semi-rigid layer pieces.

Referring again to the embodiment including the centre layer, when the ends 17 and 18 are drawn together (upwards in FIGS. 2 and 3), the reservoir 14 is compressed and the liquid or paste 19 contained therein is forced out of the hole 16 and onto the article desired (food etc.).

The hole 16 is located in layer 13 proximate the transverse score 15. In this particular example, the aperture is an oval hole 16. Alternatively, the hole could be in the form of a slit or other shape, and aligned with the transverse score. Such variations are considered within the scope of the present invention.

The configuration of the particular example described herein is particularly advantageous in that upon drawing the ends 17 and 18 together the score is fractured and the substance contained within the reservoir 14 may be then extruded or forced through the hole 16 in a controlled manner. Further the edge formed by the transverse score 15 may be used to spread the substance or distribute it onto the article as desired. It is considered that this provides more control over where or how the substance in reservoir 14 may be spread or deposited than the prior art devices and further does not require the use of a separate spreading implement.

An alternative embodiment may omit the centre plastics layer 13 incorporating the hole 16. This construction is most suitable for cases where the aperture formed by the fracture is located and sized so as to provide the desired degree of control for expulsion of the material. Where the rigid layer fractures completely in two, the middle layer defines the exit aperture for the packaged material.

While the present example has been described with reference to an elongate sachet, it is envisaged that other shapes are possible such as oval, circular or the like. Also, while the particular example has been described with reference to a condiment or liquid substance for use with foodstuffs, the present invention could equally be used in the application of medical substances such as antiseptics, burn treatments and the like. In this application, the present invention could additionally have an absorbent layer located proximate the exit aperture and extend over the exposed surface of layer 11 as desired. The absorbent layer could further be covered by a sterile protective strip which may be torn off to expose the absorbent layer.

Further, the sachet could be constructed so that the reservoir is significantly larger than the semi-rigid layer. In this alternative embodiment, the rigid layer and fracture would act more as an opening means for a larger reservoir. It is envisaged that volumes of 1 to 2 liters could be accommodated by such a construction and the breakable part of the sachet be located conveniently on the wall of the reservoir so that upon bending the fracture is formed and the enclosed substance extracted by squeezing the reservoir.

Further, the reservoir shape need not be limited to elongate or oval. The reservoir may be formed so as to be in a distinctive shape such as a well known bottle outline or similar recognisable outline.

Figure 5:
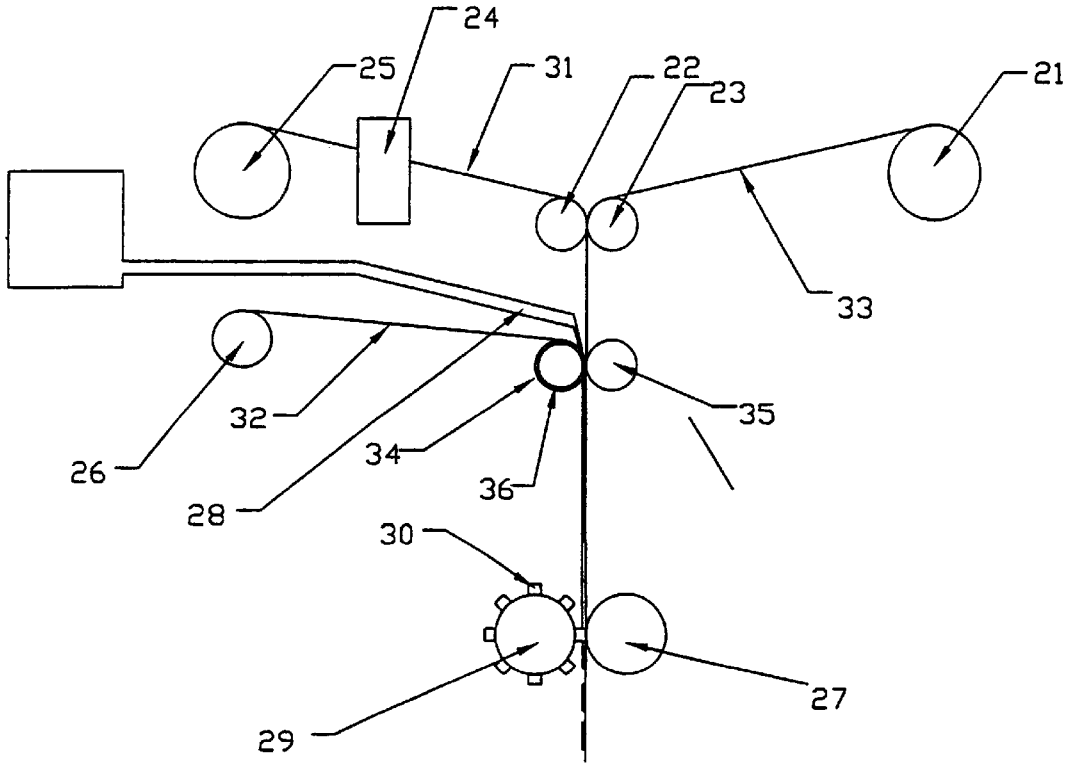
FIG. 5 illustrates a schematic of an apparatus for manufacturing the sachets.

Referring to FIG. 5 an apparatus for the manufacture of the sachets is shown. One novel aspect of the process resides in the method of forming each of the sachet reservoirs. The particular example shown is for the manufacture of sachets including a single semi-rigid layer and two flexible plastics layers as described above wherein the two flexible plastics layers form the reservoir for containing the substance. The layers are fed from continuous rolls 21, 26 and 25. The middle layer 31 has an aperture formed therein by means of a device 24. Such a device may operate by melting, punching or a similar technique known in the art. The spacing and location of the holes is calculated based on the sachet dimensions and the location of the fracture point or "score" in the semi-rigid layer. The fracture point may be preformed in the semi-rigid layer or formed during the manufacture process. As discussed above, the score may be smaller than the width of the sachet, thus providing a different fracture characteristic. The layers 31 and 33 could alternatively be pre-laminated and then fed into the roller system at roller 35 where the sachet contents is injected.

Layers 31 and 33 are continuously fed to heated rollers 22 and 23 wherein they are thermally bonded together. Layer 32 is continuously fed to heated rollers 34 and 35 where layer 32 is thermally bonded to a continuous portion of the surface of layer 31. Heated roller 34 is shaped so that upon continuous movement of the layers through the rollers only the edges of the layer 32 are bonded to the aforementioned layers so that a lengthwise continuous reservoir is formed from below the heated rollers 34 and 35. In cross section, roller 35 is "dumbbell" shaped with the edges locating adjacent roller 35 sealing the layers together at their edges. The heat sealing step may be repeated to ensure effective closure. It is possible that in the initial heating step, the 'squeezing' of the contents away from the sealing zone may conduct heat away thus producing an imperfect seal. The subsequent sealing step is intended to address this potential difficulty.

A delivery tube 28 is located in such a manner so that it extends between rollers 34 and 35 through the space formed by the shape of the roller 34. The delivery tube 28 extends downwards substantially into the continuous reservoir. Fluid, for example, is continuously supplied to the delivery system 28 so as to fill the continuous reservoir up to a constant level. This has the added advantage of excluding air from the reservoir to reduce the possibility of reaction or deterioration of the fluid contained therein. The fluid filled continuous reservoir then travels through heated rollers 29 and 27 wherein heated elements 30 compress the layer 32 against roller 27 thereby forcing the liquid out of the contact region 37 and thermally bonding the layer 32 to the layer 31 (which is already bonded to semi-rigid layer 33).

A variation of the present sachet includes a further sealing step whereby a strip of layer 12 and 13 is bonded together along the line of the fracture line. Such a bonded strip would divide the reservoir into two components with communication possible via the hole 16. Such a configuration may allow improved control when the contents is squeezed out of the reservoirs.

In a further embodiment, the substance to be contained in the reservoir may be simply dropped onto the top surface of layer 32. This technique is suitable for particularly viscous substances.

It is to be appreciated that the present description describes a single vertical continuous reservoir arrangement. However for different layer widths, roller 34 may be shaped so as to form a plurality of continuous reservoirs running vertically parallel through the roller system. In this case a number of delivery tubes 28 will be required. This alternative embodiment is considered within the scope of the invention. A further variation uses a divider wheel which separates the reservoir into two vertically oriented reservoirs.

The web of sachets produced may be subsequently fed into a cutting machine or transported in a roll for further processing.

The substance fed through delivery system 28 may be liquid or paste or similar, and may be fed under pressure or by gravity feed. The feed rate may be regulated so as to maintain a constant head of liquid in the continuous reservoir region above the heated rollers 29 and 27 so as to exclude air from the sachet reservoir.

A further advantage of the present invention is that layers 31, 32 or 33 may have preprinted material on them with the semi-rigid layer providing a particularly useful surface on which to place identify, decorative or similar graphical material. The manufacturing system shown in FIG. 5 may also include perforating rollers (not shown) which provide perforations between the sachet elements 10. In this configuration webs of sachets may be delivered in a roll and broken off by hand as required.

While the present apparatus and sachet has been described in the context of plastics films and layers, it is envisaged that under certain circumstances paper layers or combinations of paper and plastics may be used, depending on the substance to be contained within the sachet and/or the tolerance of the substance to the bonding temperature. Such variations are considered within the scope of the present invention.

The apparatus shown in FIG. 5 may be further adapted to include different numbers of layers depending on the construction of the sachet required and the nature of the substance to be contained therein. Further, there may be more than one separate reservoir in each sachet unit. Such variations may include a plurality of holes associated with a specific reservoir. This would allow for mixing of, for example, two substances such as glues comprising a bonding agent and activator.

Thus by the invention there is provided a convenient sachet for use in dispensing, for example, foodstuffs in the form of liquid, paste or similar. The sachet may be also used for dispensing medical substances wherein the apparatus in FIG. 5 operates in a sterile environment.

In use the sachets are convenient and clean. Trial and experimentation have found that the sachets are resistant to puncturing and cracking along the transverse score 15 as well as to pressure exerted on the reservoir.

The sachets may be manufactured in convenient sizes, the dimensions and shape of which allow for easy storage, transport and display (in retail situations). The sachets are also particularly suitable for distribution from a dispensing device.

The apparatus of FIG. 5 may also be readily modified whereby the height of the heated elements 30 and the depth of the heated roller 34 (shown by dotted line 36) may be varied to allow for a range of reservoir volumes.

Although the invention has been described by way of example and with reference to particular embodiments it is to be understood that modifications and/or improvements may be made without departing from the scope of the appended claims.

Where in the foregoing description reference has been made to integers or elements having known equivalents, then such equivalents are herein included as if individually set forth.

I claim:

1. A sachet for the storage and application of liquid/paste substances, the sachet having been manufactured by a method comprising the steps of; sandwiching two plastic layers and one semi-rigid layer together to form a continuous elongate reservoir having an elongate direction, where the plastic layer adjacent to the semi-rigid layer has an aperture formed therein prior to forming said continuous reservoir; filling the elongate reservoir with at least one of a liquid and a paste; feeding the filled elongate reservoir continuously through a hot roller, the hot roller sealing the continuous elongate reservoir substantially perpendicular to the elongate direction of said continuous elongate reservoir to form discrete reservoirs corresponding to each sachet reservoir; and forming a fracture line or score in the semi-rigid layer, the fracture line or score either being formed during manufacture or being preformed in the semi-rigid layer; the sachet comprising said plastic layers sandwiched together to form the reservoir wherein at least one of said plastic layers is the semi-rigid plastic which fractures when bent, said semi-rigid plastic layer forming an outside layer of said plastic layers wherein the plastic layer adjacent to the semi-rigid plastic layer has the aperture located proximate to said fracture.

2. A sachet as claimed in claim 1 wherein the sachet has a shape which is one of elongate and oval.

3. A sachet as claimed in claims 1 or 2, wherein the semi-rigid plastic layer is smaller than the reservoir formed from a first said flexible plastic layer and a second said flexible plastic layer, and a geometry of the plastic layers is such that the reservoir forms a flexible bag and the semi-rigid plastic layer includes an opening means for opening said reservoir.

4. A sachet for the storage and application of liquid/paste substances, the sachet having been manufactured by a method comprising the steps of; sandwiching two plastic layers and one semi-rigid layer together to form a continuous elongate reservoir having an elongate direction, where the plastic layer adjacent to the semi-rigid layer has an aperture formed therein prior to forming said continuous reservoir; filling the elongate reservoir with at least one of a liquid and a paste; feeding the filled elongate reservoir continuously through a hot roller, the hot roller sealing the continuous elongate reservoir substantially perpendicular to the elongate direction of said continuous elongate reservoir to form discrete reservoirs corresponding to each sachet reservoir; and forming a fracture line or score in the semi-rigid layer, the fracture line or score either being formed during manufacture or being preformed in the semi-rigid layer, the sachet comprising said plastic layers sandwiched together to form the reservoir, wherein at least one said plastic layer is the semi-rigid layer which fractures at a fracture position when bent, said semi-rigid plastic layer forming an outside layer of said plastic layers wherein the plastic layer adjacent to the semi-rigid layer has the aperture located proximate to said fracture position.

5. A method of manufacturing a sachet comprising the steps of:

sandwiching two plastic layers and one semi-rigid layer together to form a continuous elongate reservoir having an elongate direction, where the plastic layer adjacent to the semi-rigid layer has an aperture formed therein prior to forming said continuous reservoir;

filling the elongate reservoir with at least one of a liquid and a paste;

feeding the filled elongate reservoir continuously through a hot roller, the hot roller sealing the continuous elongate reservoir substantially perpendicular to the elongate direction of said continuous elongate reservoir to form discrete reservoirs corresponding to each sachet reservoirs; and forming a fracture line or score in the semi-rigid layer, the fracture line or score either being formed during manufacture or being preformed in the semi-rigid layer.

6. A method of manufacturing a sachet as claimed in claim 5, further comprising the step of pre-laminating the semi-rigid plastic layer and the adjacent plastic layer before adding any further layers.

7. A method of manufacturing a sachet as claimed in claims 5 or 6, wherein the continuous elongate reservoir is oriented substantially vertically and is filled using a delivery means for delivering at least one of the liquid and the paste, the delivery means having an outlet located in the continuous elongate reservoir formed between the two plastic layers.

8. A method of manufacturing a sachet as claimed in claims 5 or 6, further comprising the step of sealing the plurality of plastic layers using at least one of heat and heat activated glue.

* * * * *

UNITED STATES PATENT AND TRADEMARK OFFICE

CERTIFICATE OF CORRECTION

PATENT NO. : 6,041,930
DATED : March 28, 2000
INVENTOR(S) : Harry George Cockburn It is certified that error appears in the above-identified patent and that said Letters Patent is hereby corrected as shown below:

ON COVER PAGE AT [56] REFERENCES CITED U.S. PATENT DOCUMENTS

"4,371,080 2/1983 Hainess et al." should read
--4,371,080 2/1983 Haines et al.--.

ON COVER PAGE AT [73] ASSIGNEE

"New Zealand" should read —Christchurch, New Zealand--.

COLUMN 8

Line 12, "reservoirs;" should read--reservoir--.

Signed and Sealed this

Fifth Day of June, 2001

Nicholas P. Godici

NICHOLAS P. GODICI

*Acting Director of the United States Patent and Trademark Office*

*Attest:*

*Attesting Officer*